US007748963B2

(12) United States Patent
Lee et al.

(10) Patent No.: US 7,748,963 B2
(45) Date of Patent: Jul. 6, 2010

(54) LINEAR COMPRESSOR

(75) Inventors: Jong Koo Lee, Suwon-si (KR); Gye Young Song, Kwangmyung-si (KR)

(73) Assignee: LG Electronics Inc., Seoul (KR)

( * ) Notice: Subject to any disclaimer, the term of this patent is extended or adjusted under 35 U.S.C. 154(b) by 1071 days.

(21) Appl. No.: 11/037,014

(22) Filed: Jan. 19, 2005

(65) Prior Publication Data

US 2006/0093496 A1 May 4, 2006

(30) Foreign Application Priority Data

Nov. 3, 2004 (KR) ..... 10-2004-0088792

(51) Int. Cl.
*F04B 17/00* (2006.01)
*F04B 17/04* (2006.01)
*F04B 35/04* (2006.01)

(52) U.S. Cl. ..... 417/417; 417/415

(58) Field of Classification Search ..... 417/417, 417/415, 418, 372; 184/6.16

See application file for complete search history.

(56) References Cited

U.S. PATENT DOCUMENTS 1,718,934 A * 7/1929 Adams ..... 123/71 R
6,089,836 A * 7/2000 Seo ..... 417/417
6,571,917 B1 * 6/2003 Hyun ..... 184/6.16

FOREIGN PATENT DOCUMENTS

CN 1157028 A 8/1997
KR 0162244 B1 3/1999

* cited by examiner

*Primary Examiner*—Charles G Freay
*Assistant Examiner*—Peter J Bertheaud
(74) *Attorney, Agent, or Firm*—Birch, Stewart, Kolasch & Birch, LLP

(57) ABSTRACT

Disclosed herein is a linear compressor, which is designed in such a fashion that oil is suctioned into a space between a cylinder and a piston by a low pressure produced between the cylinder and the piston when the piston moves backward, and then is discharged to the outside by a high pressure produced between the cylinder and the piston when the piston moves forward, resulting in a simplified oil pumping structure and low cost.

13 Claims, 3 Drawing Sheets

LINEAR COMPRESSOR

BACKGROUND OF THE INVENTION

1. Field of the Invention

The present invention relates to a linear compressor adapted to compress fluid, such as refrigerant gas, and more particularly to a linear compressor in which a high or low pressure is produced in a space between a cylinder and a piston upon reciprocation of the piston to enable oil to be supplied into the space between the cylinder and the piston.

2. Description of the Related Art

Generally, linear compressors are machines used to suction and compress fluid, such as refrigerant gas, and discharge the compressed fluid as a piston rectilinearly reciprocates inside a cylinder by making use of driving power of a linear motor.

FIG. 1 is a sectional view illustrating a conventional linear compressor.

As shown in FIG. 1, the conventional linear compressor comprises a shell 2, a liner compressing unit 10, and an oil pump 20. The shell 2 receives oil O in a bottom region thereof, and the linear compressing unit 10 is disposed in the shell 2 to vibrate under operation of a damper 8. The linear compressing unit 10 serves to suction and compress fluid and discharge the compressed fluid. The oil pump 20, located below the linear compressing unit 10, is adapted to pump the oil O received in the bottom region of the shell 2 into the linear compressing unit 10 upon vibration of the linear compressing unit 10.

A fluid suction pipe 3 and a fluid discharge pipe 4 pass into the shell 2, and the fluid discharge pipe 4 is also connected to the linear compressing unit 10. In this way, the fluid is suctioned into the shell 2 via the suction pipe 3, and then is discharged via the discharge pipe 4 after being compressed in the linear compressing unit 10.

The linear compressing unit 10 comprises a cylinder block 16 provided with a cylinder 12, a back cover 24 provided with a fluid suction pipe 22, and a piston 30 rectilinearly reciprocably disposed inside the cylinder 12. The piston 30 internally defines a fluid suction channel 28 for allowing the fluid to be suctioned into the cylinder 12. The linear compressing unit 10 further comprises a fluid suction valve 32 installed in the piston 30 to open or close the fluid suction channel 28, a linear motor 34 for rectilinearly reciprocating the piston 30, and a discharge valve assembly 36 provided to open or close a front end of the cylinder 12. To the discharge valve assembly 36 of the linear compressing unit 10 is connected the fluid discharge pipe 4.

In addition, for the lubrication/cooling of the cylinder 12 and the piston 30, the linear compressing unit 10 comprises an oil suction channel 37 and an oil discharge channel 38.

The oil suction channel 37 is a combination of an oil pipe 39, an oil cover 41, a cylinder block suction channel 42, and a cylinder suction channel 43. The oil pipe 39 is immersed at an end thereof in the oil O received in the bottom region of the shell 2. The oil cover 41 is coupled to the cylinder block 16 to define an oil passage 40 therebetween. The cylinder block suction channel 42 serves to guide the oil from the oil passage 40 through the cylinder block 16, and the cylinder suction channel 43 serves to supply the oil from the cylinder block suction channel 42 to a space defined between the cylinder 12 and the piston 30.

The oil pump 20 comprises an oil cylinder 44, an oil piston 45, and front and rear oil springs 46 and 47. The oil cylinder 44 is mounted below the linear compressing unit 10 to communicate with the oil suction channel 37, more particularly, to the oil passage 40. The oil piston 45 is rectilinearly reciprocably disposed inside the oil cylinder 44, and the oil springs 46 and 47 are positioned at opposite sides of the oil piston 45 inside the oil cylinder 41 to elastically support the oil piston 45.

Reference numeral 48 denotes an oil suction valve, which operates by a pressure difference between the oil pipe 39 and the oil passage 40 to open or close an entrance of the oil passage 40. Reference numeral 49 denotes an oil discharge valve, which operates by a pressure difference between the oil passage 40 and the cylinder block suction channel 42 to open or close an exit of the oil passage 40.

In the conventional linear compressor configured as stated above, the oil piston 45 of the oil pump 20 vibrates as the linear compressing unit 10 vibrates.

When the oil piston 45 moves backward, a low pressure is produced in the oil passage 40 to open the oil suction valve 48, thereby causing the oil O to be suctioned via the oil pipe 39 and filled in the oil passage 40.

On the other hand, when the oil piston 45 moves forward, a high pressure is produced in the oil passage 40 to open the oil discharge valve 49, thereby causing the oil O, filled in the oil passage 40, to pass, in sequence, the cylinder block suction channel 42 and the cylinder suction channel 43, and to be supplied into the space between the cylinder 12 and the piston 30.

The supplied oil between the cylinder 12 and the piston 30 is used to lubricate/cool the cylinder 12 and the piston 30, and then is discharged to the outside of the linear compressing unit 10 via the oil discharge channel 38. The discharged oil is again collected in the bottom region of the shell 2.

However, the above described conventional linear compressor has a problem in that it requires a number of oil pumping elements including the oil cylinder 44, the oil piston 45, and the front and rear oil springs 46 and 47, resulting in a complicated pumping structure and high cost.

Further, as a result of positioning the oil cylinder 44, the oil piston 45, and the front and rear oil springs 46 and 47 below the linear compressing unit 10, it is impossible to arrange terminals of the linear motor 34 below the linear compressing unit 10. This significantly restricts space utility of the linear compressor.

SUMMARY OF THE INVENTION

Therefore, the present invention has been made in view of the above problems, and it is an object of the present invention to provide a linear compressor which has a simplified oil pumping structure and low cost.

It is another object of the present invention to provide a linear compressor which is simplified in the structure of a region below a linear compressing unit, resulting in an improvement in space utility of the region below the linear compressing unit.

In accordance with one aspect of the present invention, the above and other objects can be accomplished by the provision of a linear compressor comprising: an oil suction channel configured to allow oil to be introduced into a space between a cylinder and a piston; an oil discharge channel configured to allow the oil between the cylinder and the piston to be discharged to the outside of the cylinder; and pumping device formed at the cylinder and the piston, the pumping device producing a low pressure between the cylinder and the piston when the piston moves in a first direction so as to allow the oil to be suctioned into the space between the cylinder and the piston via the oil suction channel, and producing a high pressure between the cylinder and the piston when the piston moves in a second direction so as to allow the oil between the cylinder and the piston to be discharged via the oil discharge channel.

In accordance with another aspect of the present invention, the above and other objects can be accomplished by the provision of a linear compressor comprising: a shell in which oil is received; a cylinder block disposed inside the shell; a cylinder mounted in the cylinder block; a piston rectilinearly reciprocably disposed in the cylinder; an oil suction channel configured to allow the oil received in the shell to be introduced into a space between the cylinder and the piston; an oil discharge channel defined in the cylinder to allow the oil between the cylinder and the piston to be discharged to the outside of the cylinder block; and pumping device formed at the cylinder and the piston, the pumping device producing a low pressure between the cylinder and the piston when the piston moves in a first direction so as to allow the oil to be suctioned into the space between the cylinder and the piston via the oil suction channel, and producing a high pressure between the cylinder and the piston when the piston moves in a second direction so as to allow the oil between the cylinder and the piston to be discharged via the oil discharge channel.

Preferably, the oil suction channel may include: an oil pipe mounted in the cylinder block so that an end thereof is immersed in the oil received in a bottom region of the shell; an oil cover coupled to the cylinder block to define an oil passage therebetween, the oil passage communicating with the oil pipe; a cylinder block suction channel defined in the cylinder block to allow the oil suctioned through the oil passage to pass through the cylinder block; and a cylinder suction channel defined in the cylinder to allow the oil in the cylinder block suction channel to be suctioned into the pumping device.

Preferably, the oil discharge channel may include: a cylinder discharge channel defined in the cylinder to allow the oil inside the pumping device to be discharged; and a cylinder block discharge channel defined in the cylinder block to allow the oil discharged from the cylinder discharge channel to pass through the cylinder block and be discharged.

Preferably, the linear compressing may further comprise an oil suction valve adapted to open an end of the oil suction channel upon receiving the low pressure produced by the pumping device when the piston moves in the first direction, and to close the end of the oil suction channel when the low pressure is released.

Preferably, the linear compressing may further comprise an oil discharge valve adapted to open an end of the oil discharge channel upon receiving the high pressure produced by the pumping device when the piston moves in the second direction, and to close the end of the oil discharge channel when the high pressure is released.

Preferably, the pumping device may include: a stepped cylinder portion formed at an inner peripheral surface of the cylinder; and a stepped piston portion formed at an outer peripheral surface of the piston, whereby the low pressure is produced between the stepped cylinder portion and the stepped piston portion when the piston moves in the first direction, and the high pressure is produced between the stepped cylinder portion and the stepped piston portion when the piston moves in the second direction.

Preferably, the stepped cylinder portion and the stepped piston portion may have identical, matching inclinations.

Preferably, a portion of the cylinder in front of the stepped cylinder portion may have an inner diameter, which is smaller than an outer diameter of a portion of the piston in rear of the stepped piston portion.

Preferably, the stepped cylinder portion and the stepped piston portion may define a cylindrical space therebetween when the piston moves in the first direction.

In accordance with another aspect of the present invention, the above and other objects can be accomplished by the provision of a linear compressor comprising: a shell in which oil is received; a cylinder block disposed inside the shell; a cylinder mounted in the cylinder block and formed at an inner peripheral surface thereof with a stepped cylinder portion; a piston rectilinearly reciprocably disposed in the cylinder and formed at an outer peripheral surface thereof with a stepped piston portion, upon reciprocation of the piston, oil suction and discharge pressures being produced between the stepped piston portion and the stepped cylinder portion; an oil suction channel configured to allow the oil received in the shell to be introduced into a space between the stepped cylinder portion and the stepped piston portion when a low pressure is produced therebetween; an oil discharge channel configured to allow the oil between the stepped cylinder portion and the stepped piston portion to be discharged to the outside of the cylinder block when a high pressure is produced therebetween; an oil suction valve adapted to open or close an end of the oil suction channel; and an oil discharge valve adapted to open or close an end of the oil discharge channel.

In the linear compressor configured as stated above according to the present invention, oil is suctioned by a low pressure produced between a cylinder and a piston when the piston moves backward, and then is discharged by a high pressure produced between the cylinder and the piston when the piston moves forward, achieving a simplified oil pumping structure and low cost.

Further, according to the linear compressor of the present invention, the configuration of a region below a linear compressing unit is simplified to enable terminals of a linear motor to be disposed in the region, resulting in an improvement of space utility.

Furthermore, according to the linear compressor of the present invention, pumping device, which consists of a pair of stepped portions formed at an inner peripheral surface of the cylinder and an outer peripheral surface of the piston, is easy to mold and thus can eliminate a separate fastening process, resulting in an easy manufacturing process.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a preferred embodiment of a linear compressor according to the present invention will be explained with reference to the accompanying drawings.

Figure 1:
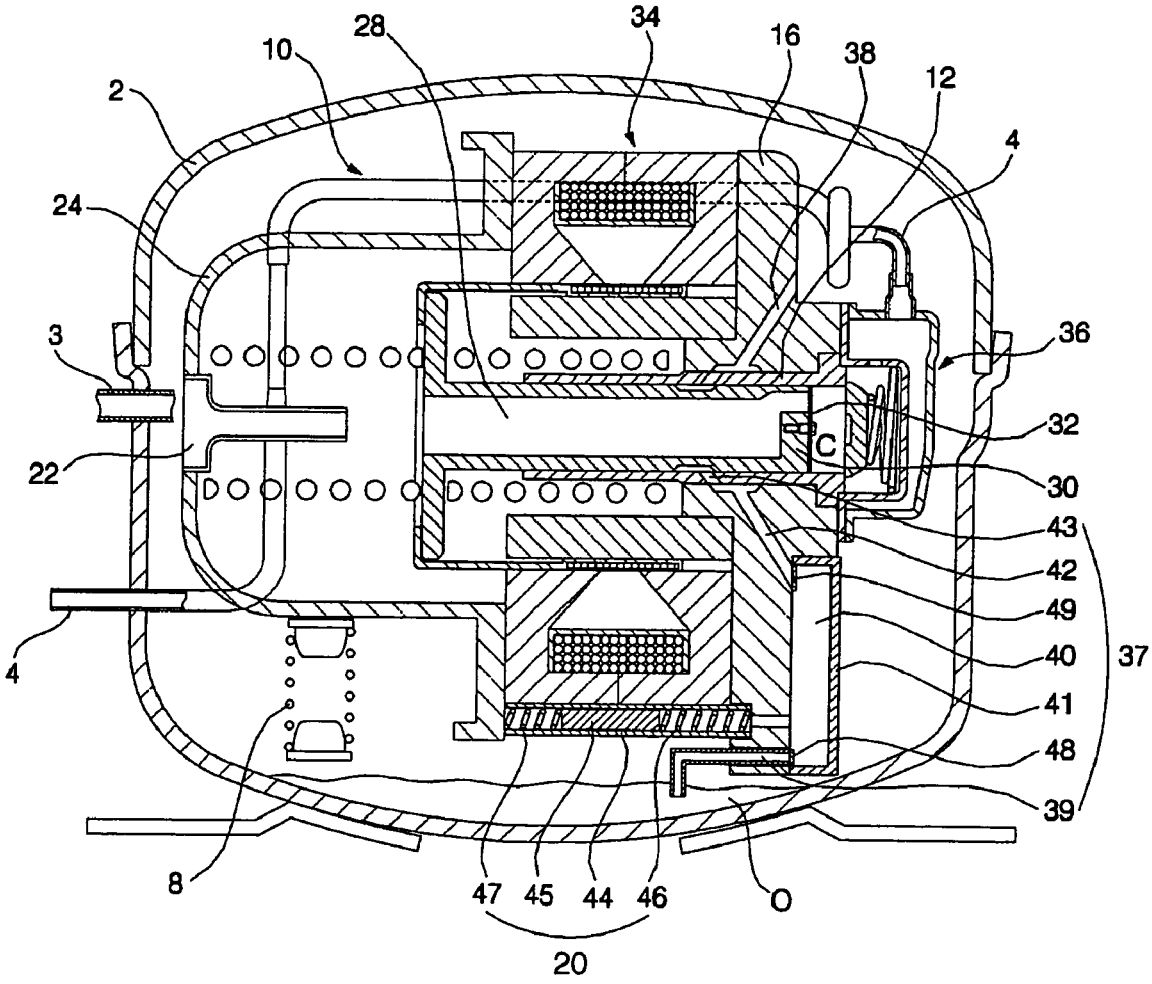
FIG. 1 (Prior Art)
FIG. 1 is a cross sectional view illustrating a conventional linear compressor.
Figure 2:
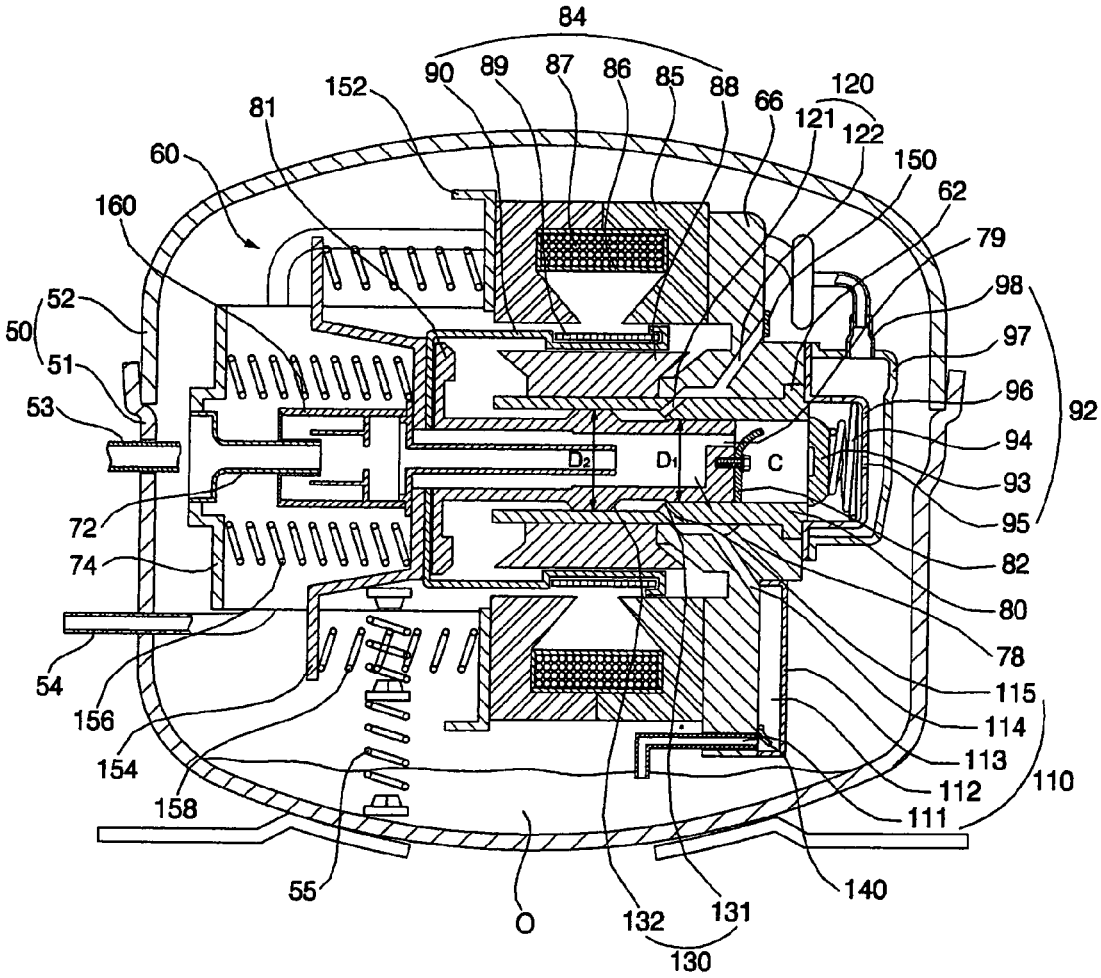
FIG. 2 is a cross sectional view illustrating a linear compressor in accordance with an embodiment of the present invention, upon backward movement of a piston.
Figure 3:
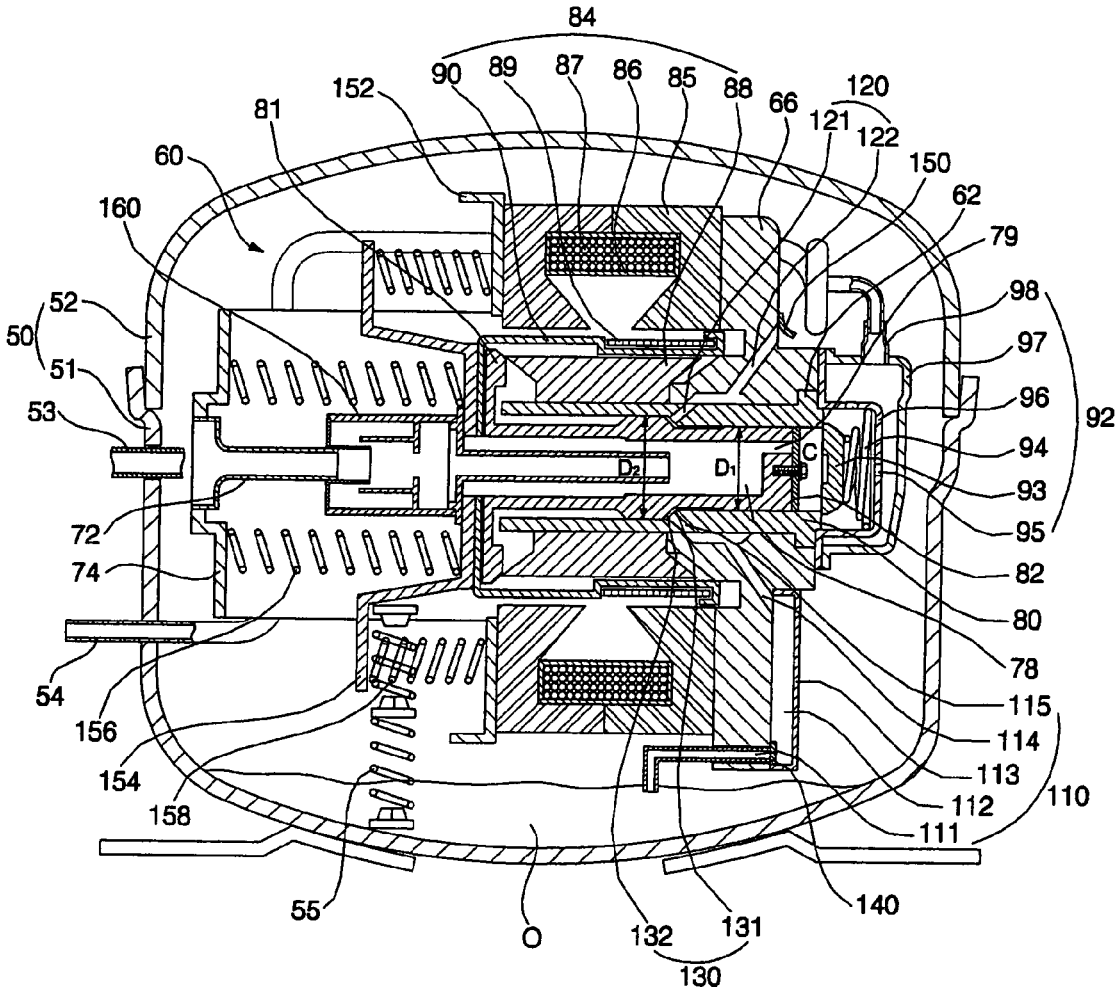
FIG. 3 is a cross sectional view illustrating a linear compressor in accordance with the embodiment of the present invention, upon forward movement of the piston.

FIG. 2 is a cross sectional view illustrating a linear compressor in accordance with an embodiment of the present invention, upon backward movement of a piston. FIG. 3 is a cross sectional view of the linear compressor, upon forward movement of the piston.

As shown in FIGS. 2 and 3, the linear compressor of the present invention comprises a linear compressing unit 60 mounted in a shell 50 in a shock-absorbing manner.

The shell 50 is divided into a lower shell 51 having an open upper surface and an upper shell 52 configured to cover the upper surface of the lower shell 51. The lower and upper shells 51 and 52 are coupled to each other to define a hermetic space therebetween. The lower shell 51 receives oil (O) in a bottom region thereof.

A fluid suction pipe 53 and a fluid discharge pipe 54 pass into the shell 50. The fluid discharge pipe 54 is also connected to the linear compressing unit 60 to discharge fluid, compressed in the linear compressing unit 60, to the outside.

The linear compressing unit 60 is supported on a damper 55 mounted in the lower shell 51 to vibrate under operation of the damper 55.

The linear compressing unit 60 comprises a cylinder block 66 provided with a cylinder 62, a back cover 74 provided with a fluid suction pipe 72, and a piston 80 rectilinearly reciprocably disposed in the cylinder 62. The piston 80 internally defines a fluid suction channel 78 and a fluid suction port 79 for allowing the fluid to be suctioned into the cylinder 62. The linear compressing unit 60 further comprises a suction valve 82 installed in the piston 80 to open or close the fluid suction channel 78, a linear motor 84 for rectilinearly reciprocating the piston 80, and a discharge valve assembly 92 coupled to the cylinder block 66 to define a compression chamber C between the discharge valve assembly 92 and the piston 80. If the fluid in the compression chamber C is compressed beyond a predetermined pressure, the discharge valve assembly 92 operates to discharge the compressed fluid via the discharge pipe 54.

The cylinder 62 is centered in the cylinder block 66.

The back cover 74 is coupled to a stator cover by means of fastening means, such as bolts. The stator cover, designated as reference numeral 152, will be explained hereinafter.

At a rear end of the piston 80 is formed a flange 81. The flange 81 is coupled to the linear motor 84 by means of fastening means, such as bolts, and is adapted to receive driving power of the linear motor 84.

The suction valve 82 is an elastic member coupled to a front end surface of the piston 80 by means of fastening bolts. The suction valve 82 serves to open or close the suction port 79 by a pressure difference between the compression chamber C and the suction port 79.

The linear motor 84 has an outer core 85, a bobbin 86, and a coil 87, an inner core 88, a magnet 89, and a magnet frame 90. The outer core 85 is mounted at the cylinder block 66, and in turn, the bobbin 86 is mounted in the outer core 85. Around the bobbin 86 is wound the coil 87. The inner core 88 is also mounted at the cylinder block 66 so that a predetermined gap is defined between the outer core 85 and the inner core 88. The magnet 89 is located between the outer core 85 and the inner core 88 to rectilinearly reciprocate by making use of electromagnetic force produced by the coil 87. The magnet frame 90, around which the magnet 89 is mounted, is coupled to the flange 81 of the piston 80 and is adapted to transmit rectilinear movement force to the piston 80.

The discharge valve assembly 92 has a discharge valve 93, a discharge spring 94, an inner discharge cover 96, an outer discharge cover 97, and a connection pipe 98. The discharge valve 93 serves to open or close a front end of the cylinder 62, and is elastically supported by the discharge spring 94. The inner discharge cover 96 is formed with a fluid discharge hole 95, and the outer discharge cover 97 is coupled to the inner discharge cover 96 to define a channel therebetween. The connection pipe 98 is connected at one end thereof to the outer discharge cover 97, and at the other end thereof to the discharge pipe 54.

Meanwhile, the linear compressing unit 60 internally defines an oil suction channel 110, and an oil discharge channel 120. The oil O, received in the shell 50, is introduced into a space between the piston 80 and the cylinder 62 via the oil suction channel 110, and the oil O between the piston 80 and the cylinder 62 is discharged to the outside of the linear compressing unit 60 via the oil discharge channel 120. For the introduction and discharge of the oil O, the linear compressing unit 60 is provided with pumping device 130. When the piston 80 moves backward as shown in FIG. 2, the pumping device 130 produces a low pressure between the cylinder 62 and the piston 80. Conversely, when the piston 80 moves forward as shown in FIG. 3, the pumping device 130 produces a high pressure between the cylinder 62 and the piston 80.

The oil suction channel 110 is a combination of an oil pipe 111, an oil cover 113, a cylinder block suction channel 114, and a cylinder suction channel 115. The oil pipe 111 is mounted in the cylinder block 66 so that an end thereof is immersed in the oil O received in the bottom region of the shell 50. The oil cover 113 is coupled to the cylinder block 66 to define an oil passage 112 therebetween. The oil passage 112 communicates with the oil pipe 111. The cylinder block suction channel 114, defined in the cylinder block 66, allows the oil suctioned through the oil passage 112 to pass through the cylinder block 66. The cylinder suction channel 115, defined in the cylinder 62, allows the oil in the cylinder block suction channel 114 to be suctioned into the pumping device 130.

The oil discharge channel 120 is a combination of a cylinder discharge channel 121 defined in the cylinder 62 for guiding the oil from the pumping device 130 to the outside, and a cylinder block discharge channel 122 defined in the cylinder block 66 for guiding the oil from the cylinder discharge channel 121 to pass through the cylinder block 66.

The pumping device 130 has a stepped cylinder portion 131 formed at an inner peripheral surface of the cylinder 62, and a stepped piston portion 132 formed at an outer peripheral surface of the piston 80. The stepped piston portion is formed by the piston sidewall having an increased thickness, allowing for the formation of a stepped portion while allowing the inner diameter of the piston to remain substantially constant. When the piston 80 moves backward, a low pressure is produced between the stepped cylinder portion 131 and the stepped piston portion 132. Conversely, when the piston 80 moves forward, a high pressure is produced between the stepped cylinder portion 131 and the stepped piston portion 132.

The stepped cylinder portion 131 and the stepped piston portion 132 have identical, matching inclinations.

The cylinder 62 is configured so that a portion of the cylinder 62 in front of the stepped cylinder portion 131 has an inner diameter $D_1$, which is smaller than an outer diameter $D_2$ Of a portion of the piston 80 in rear of the stepped piston portion 132.

When the piston 80 moves backward, the stepped cylinder portion 131 and the stepped piston portion 132 define a cylindrical space therebetween.

Meanwhile, the linear compressing unit 60 further comprises an oil suction valve 140, which serves to open or close the oil suction channel 110. When the piston 80 moves backward, the oil suction valve 140 opens the oil suction channel 110 by the low pressure produced by the pumping device 130.

Then, as soon as the lower pressure is released, the oil suction valve 140 closes the oil suction channel 110.

The oil suction valve 140 is an elastic member coupled to the cylinder block 66 by means of fastening means, such as bolts. The oil suction valve 140 opens the oil suction channel 110, namely, an entrance of the oil passage 112 as it partially bends.

The linear compressing unit 60 further comprises an oil discharge valve 150, which serves to open or close the oil discharge channel 120. When the piston 80 moves forward, the oil discharge valve 150 opens the oil discharge channel 120 by the high pressure produced by the pumping device 130. Then, as soon as the high pressure is released, the oil discharge valve 150 closes the oil discharge channel 120.

The oil discharge valve 150 is an elastic member coupled to the cylinder block 66 by means of fastening means, such as bolts. The oil discharge valve 150 opens the oil discharge channel 120, namely, an exit of the cylinder block discharge channel 122 as it partially bends.

Reference numeral 152 denotes the stator cover, which is coupled to the outer core 85 by means of fastening means, such as bolts, to cover a rear surface of the outer core 85.

Reference numeral 154 denotes a spring supporter, which is coupled to the flange 81 of the piston 80 by means of fastening means, such as bolts. The spring supporter includes a first spring 156 disposed between the spring supporting member 154 and the back cover 74, and a second spring 158 disposed between the spring supporting member 154 and the stator cover 152.

Reference numeral 160 denotes a muffler installed at a rear end of the piston 80. The muffler 160 serves to guide the fluid, suctioned through the suction pipe 72 of the back cover 74, to the fluid suction channel 78 of the piston 80 while reducing operational noise.

Now, the operation and effects of the present invention configured as stated above will be explained.

First, if a driving voltage is applied to the coil 87 to produce a magnetic field around the coil 87, the magnet 90 near the coil 87 rectilinearly reciprocates through interaction with the magnetic field. Such a reciprocating motion of the magnet 89 is transmitted to the piston 80 via the magnet frame 90, resulting in rectilinear reciprocation of the piston 80 inside the cylinder 62.

The suction valve 82 and the discharge valve 93 are opened or closed by the pressure differences at front and rear sides of the compression chamber C caused by the rectilinear reciprocating motion of the piston 80. The fluid inside the shell 50 passes, in sequence, through the fluid suction pipe 72 of the back cover 74, the muffler 160, and the fluid suction channel 78 and the suction port 79 of the piston 80, to be suctioned into the compression chamber C. After being compressed by the piston 80, the compressed fluid passes, in sequence, through the discharge valve assembly 92 and the discharge pipe 54 to be discharged to the outside.

Meanwhile, when the piston 80 rectilinearly reciprocates as stated above, and the fluid inside the shell 50 is suctioned, compressed and discharged, the oil O received in the bottom region of the shell 50 is suctioned to the pumping device 130 by making use of a pressure variation inside the pumping device 130. The suctioned oil is used to lubricate/cool the cylinder 62 and the piston 80 and then is discharged to the outside of the linear compressing unit 60.

Now, the pressure variation inside the pumping device 130 and the resulting oil supply procedure will be explained in more detail.

When the piston 80 moves backward as shown in FIG. 2, the stepped piston portion 132 moves away from the stepped cylinder portion 131 to produce the low pressure therebetween, allowing the oil suction valve 140 to partially bend so as to open the oil suction channel 110, especially, the entrance of the oil passage 112. In this case, the oil discharge valve 150 bends upon receiving the low pressure so as to close the oil discharge channel 120, especially, the cylinder block discharge channel 122.

If the oil suction channel 110 opens, the oil, received in the bottom region of the shell 50, passes, in sequence, through the oil pipe 111, the oil passage 112, the cylinder block suction channel 114, and the cylinder suction channel 115, and then is suctioned into the space between the stepped piston portion 132 and the stepped cylinder portion 131, thereby serving to lubricate/cool the cylinder 62 and the piston 80.

On the other hand, when the piston 80 moves forward as shown in FIG. 3, the stepped piston portion 132 moves toward the stepped cylinder portion 131 to produce a high pressure between the stepped piston portion 132 and the stepped cylinder portion 131, allowing the oil suction valve 140 to close the oil suction channel 110, especially, the entrance of the oil passage 112. In this case, the oil discharge valve 150 bends upon receiving the high pressure so as to open the oil discharge channel 120, especially, the cylinder block discharge channel 122.

The oil between the stepped cylinder portion 131 and the stepped piston portion 132 passes, in sequence, through the cylinder discharge channel 121 and the cylinder block discharge channel 122 under the influence of the high pressure, thereby being discharged to the outside of the linear compressing unit 60.

It will be clearly understood that the present invention may be modified in various manners without being limited to the above described embodiment. For example, the stepped portions of the piston and the cylinder may be reversed in shape and position, and a portion of the piston in front of the stepped piston portion has an outer diameter larger than an inner diameter of a portion of the cylinder in rear of the stepped cylinder portion.

As apparent from the above description, the linear compressor according to the present invention has several effects.

The main effect of the present invention is that oil is suctioned by a low pressure produced between a cylinder and a piston when the piston moves backward, and then is discharged by a high pressure produced between the cylinder and the piston when the piston moves forward, achieving a simplified oil pumping structure and low cost.

Another effect of the present invention is that the configuration of a region of the linear compressor below a linear compressing unit is simplified to enable terminals of a linear motor to be disposed in the region, resulting in an improvement of space utility.

Yet another effect of the present invention is that pumping device, consisting of a pair of stepped portions formed at an inner peripheral surface of the cylinder and an outer peripheral surface of the piston, is easy to mold, and thus can eliminate a separate fastening process, resulting in an easy manufacturing process.

Although the preferred embodiment of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A linear compressor comprising:

a cylinder;

a piston linearly reciprocally disposed in the cylinder to compress a fluid;

a motor configured to operate the piston;

an oil suction channel configured to allow oil to be introduced into a space between the cylinder and the piston;

an oil discharge channel configured to allow the oil between the cylinder and the piston to be discharged to the outside of the cylinder; and a pumping device formed at the cylinder and the piston, the pumping device producing a low pressure between the cylinder and the piston when the piston moves in a first direction so as to allow the oil to be suctioned into the space between the cylinder and the piston via the oil suction channel, and producing a high pressure between the cylinder and the piston when the piston moves in a second direction so as to allow the oil between the cylinder and the piston to be discharged via the oil discharge channel, wherein the pumping device includes:

a stepped cylinder portion formed at an inner peripheral surface of the cylinder such that a portion of the cylinder in front of the stepped cylinder portion has an inner diameter smaller than the inner diameter of a portion of the cylinder in rear of the stepped cylinder portion; and a stepped piston portion formed at an outer peripheral surface of the piston, the stepped piston portion being formed by a section of the piston having an increased wall thickness.

2. The compressor as set forth in claim 1, further comprising:

an oil suction valve adapted to open an end of the oil suction channel upon receiving the low pressure produced by the pumping device when the piston moves in the first direction, and to close the end of the oil suction channel when the low pressure is released.

3. The compressor as set forth in claim 1, further comprising:

an oil discharge valve adapted to open an end of the oil discharge channel upon receiving the high pressure produced by the pumping device when the piston moves in the second direction, and to close the end of the oil discharge channel when the high pressure is released.

4. The compressor as set forth in claim 1, wherein the stepped cylinder portion and the stepped piston portion have identical, matching inclinations.

5. The compressor as set forth in claim 1, wherein a portion of the cylinder in front of the stepped cylinder portion has an inner diameter, which is smaller than an outer diameter of a portion of the piston in rear of the stepped piston portion.

6. The compressor as set forth in claim 1, wherein the stepped cylinder portion and the stepped piston portion define a cylindrical space therebetween when the piston moves in the first direction.

7. A linear compressor comprising:

a shell in which oil is received;

a cylinder block disposed inside the shell;

a cylinder mounted in the cylinder block;

a piston rectilinearly reciprocally disposed in the cylinder for compressing a fluid;

an oil suction channel configured to allow the oil received in the shell to be introduced into a space between the cylinder and the piston;

an oil discharge channel defined in the cylinder to allow the oil between the cylinder and the piston to be discharged to the outside of the cylinder block; and a pumping device formed at the cylinder and the piston, the pumping device producing a low pressure between the cylinder and the piston when the piston moves in a first direction so as to allow the oil to be suctioned into the space between the cylinder and the piston via the oil suction channel, and producing a high pressure between the cylinder and the piston when the piston moves in a second direction so as to allow the oil between the cylinder and the piston to be discharged via the oil discharge channel, wherein the pumping device includes:

a stepped cylinder portion formed at an inner peripheral surface of the cylinder; and a stepped piston portion formed at an outer peripheral surface of the piston, whereby the low pressure is produced between the stepped cylinder portion and the stepped piston portion when the piston moves in the first direction, and the high pressure is produced between the stepped cylinder portion and the stepped piston portion when the piston moves in the second direction, wherein the piston has a substantially constant inner diameter.

8. The compressor as set forth in claim 7, wherein the oil suction channel includes:

an oil pipe mounted in the cylinder block so that an end thereof is immersed in the oil received in a bottom region of the shell;

an oil cover coupled to the cylinder block to define an oil passage therebetween, the oil passage communicating with the oil pipe;

a cylinder block suction channel defined in the cylinder block to allow the oil suctioned through the oil passage to pass through the cylinder block; and a cylinder suction channel defined in the cylinder to allow the oil in the cylinder block suction channel to be suctioned into the pumping device.

9. The compressor as set forth in claim 7, wherein the oil discharge channel includes:

a cylinder discharge channel defined in the cylinder to allow the oil inside the pumping device to be discharged; and a cylinder block discharge channel defined in the cylinder block to allow the oil discharged from the cylinder discharge channel to pass through the cylinder block and be discharged.

10. The compressor as set forth in claim 7, further comprising:

an oil suction valve adapted to open an end of the oil suction channel upon receiving the low pressure produced by the pumping device when the piston moves in the first direction, and to close the end of the oil suction channel when the low pressure is released.

11. The compressor as set forth in claim 7, further comprising:

an oil discharge valve adapted to open an end of the oil discharge channel upon receiving the high pressure produced by the pumping device when the piston moves in the second direction, and to close the end of the oil discharge channel when the high pressure is released.

12. The compressor as set forth in claim 7, wherein a portion of the cylinder in front of the stepped cylinder portion has an inner diameter, which is smaller than an outer diameter of a portion of the piston in rear of the stepped piston portion.

13. The compressor as set forth in claim 7, wherein the stepped cylinder portion and the stepped piston portion define a cylindrical space therebetween when the piston moves in the first direction.

* * * * *